US008555573B2

(12) United States Patent
Ellison

(10) Patent No.: US 8,555,573 B2
(45) Date of Patent: Oct. 15, 2013

(54) WINDOW ASSEMBLY

(76) Inventor: Mary Lynn Ellison, Seneca, SC (US)

( * ) Notice: Subject to any disclaimer, the term of this patent is extended or adjusted under 35 U.S.C. 154(b) by 2108 days.

(21) Appl. No.: 11/207,073

(22) Filed: Aug. 18, 2005

(65) Prior Publication Data

US 2006/0037258 A1 Feb. 23, 2006

Related U.S. Application Data

(60) Provisional application No. 60/602,978, filed on Aug. 19, 2004.

(51) Int. Cl.

| | |
|---|---|
| ***E06B 3/32*** | (2006.01) |
| ***E06B 3/988*** | (2006.01) |
| ***E05C 9/00*** | (2006.01) |
| ***E05C 17/56*** | (2006.01) |
| ***E05C 19/16*** | (2006.01) |

(52) U.S. Cl.
USPC ..... 52/204.51; 52/207; 49/395; 292/251.5

(58) Field of Classification Search
USPC ..... 52/204.51, 207, 204.62, 204.67; 49/381, 394, 395, 400; 312/7.2, 326, 312/329, 292; 292/251.5
See application file for complete search history.

(56) References Cited

U.S. PATENT DOCUMENTS

| | | | | |
|---|---|---|---|---|
| 1,366,507 | A | 1/1921 | Spencer et al. | |
| 2,609,221 | A * | 9/1952 | Schultz | 292/251.5 |
| 2,946,098 | A * | 7/1960 | Migneault et al. | 52/204.51 |
| 3,050,324 | A * | 8/1962 | Faber | 292/251.5 |
| 3,111,725 | A * | 11/1963 | Brown | 52/204.51 |
| 3,631,629 | A * | 1/1972 | Bercheux | 49/256 |
| 3,647,165 | A * | 3/1972 | Whitla | 244/118.5 |
| 3,691,688 | A * | 9/1972 | Kaiserswerth | 49/394 |
| 4,910,915 | A * | 3/1990 | Sanchez | 49/255 |
| 4,941,716 | A * | 7/1990 | Rome et al. | 312/205 |
| 4,962,615 | A * | 10/1990 | Birdling | 49/381 |
| 5,155,947 | A | 10/1992 | Rivard | |
| 6,429,961 | B1 * | 8/2002 | Harary et al. | 359/296 |
| 2003/0051421 | A1 | 3/2003 | Fields | |

FOREIGN PATENT DOCUMENTS

| | | |
|---|---|---|
| WO | WO 98/09044 | 3/1998 |

* cited by examiner

*Primary Examiner* — Ryan Kwiecinski
(74) *Attorney, Agent, or Firm* — James Ray and Associates Intellectual Property, LLC

(57) ABSTRACT

A window system for installing windows which enables easy cleaning and substantially eliminates the need for window frames. The window system comprises at least one pane of glass having each of a predetermined width, height and thickness for at least partially covering an opening formed in a wall of a structure. There are at least two hinges disposed along the predetermined height of the pane of glass on a predetermined side thereof. The first one of the at least two hinges being secured to the predetermined side adjacent one end thereof and a second one of the at least two hinges being secured to the predetermined side adjacent a radially opposed end thereof. There is at least one magnet secured to the pane of glass or to such opening formed in such building and at least one metallic member disposed on an opposite one of the pane of glass and such opening formed in such building for maintaining the pane of glass in a closed position.

8 Claims, 3 Drawing Sheets

WINDOW ASSEMBLY

CROSS REFERENCE TO RELATED APPLICATIONS

This application is closely related to and claims benefit from U.S. Provisional Application Ser. No. 60/602,978 filed Aug. 19, 2004.

FIELD OF THE INVENTION

The present invention relates, in general, to a window assembly, and more particularly, the present invention relates to a window assembly that incorporates hinges and magnetic closures on such windows and which substantially eliminates the need for window frames.

BACKGROUND OF THE INVENTION

Windows are an important part of any structure be it an office building, a store or a family residence. There is always a problem that occurs with all types of windows and that is the windows get dirty and must be cleaned periodically. Generally, there is little problem with the cleaning of the interior of such windows. However, cleaning the exterior surface of windows does present a challenge.

With office buildings, at least those with multistories, the external surfaces of these windows are generally cleaned by workers using a type of scaffolding or platforms on ropes or cables so as to get to the windows. In residential structures ladders are needed for virtually all two story buildings and even for many single story buildings.

There are a wide variety of windows that have been designed for the average home. The style of windows has changed through the years with wood frames, aluminum frames or steel frames, Also, windows can be the double hung variety or the sliding variety.

As indicated previously one problem that has plagued owners through the years has been the ability to clean the exterior surface of those windows. Double hung windows have been designed that will flip open so that the outside of the window can be cleaned from the inside. However, although this sounds like an easy chore, cleaning windows in this manner is not always as easy as it appears in advertisements.

Thus it would be ideal if a window were designed that would simplify the cleaning of the outside of the window from the interior of the building without having to risk the danger of heights to clean the outside of the window. Also, it would be desirable if windows could be designed that were much simpler to open and did not require such an expensive frame to hold the window.

SUMMARY OF THE INVENTION

Thus, the present invention provides a window system for installing windows which enables easy cleaning and substantially eliminates the need for window frames. The window system comprises at least one pane of glass having each of a predetermined width, height and thickness for at least partially covering an opening formed in a wall of a building. There are at least two hinges disposed along the predetermined height of the at least one pane of glass on a predetermined side thereof. The first one of the at least two hinges being secured to the predetermined side adjacent one end thereof and a second one of the at least two hinges being secured to the predetermined side adjacent a radially opposed end thereof. There is at least one magnet secured to at least one of the at least one pane of glass and to such opening formed in such building and at least one metallic member disposed on an opposite one of the at least one pane of glass and such opening formed in such building for maintaining the at least one pane of glass in a closed position.

An alternate embodiment of the invention provides a window system for installing windows which enables easy cleaning and substantially eliminates the need for window frames. The window system comprises at least one pane of glass having each of a predetermined width, height and thickness for at least partially covering an opening formed in a wall of a building. There are at least two hinges disposed along the predetermined height of the at least one pane of glass on a predetermined side thereof, a first one of the at least two hinges being secured to the predetermined side adjacent one end thereof and a second one of the at least two hinges being secured to the predetermined side adjacent a radially opposed end thereof and a locking member having one portion secured to one of the at least one pane of glass and another portion secured to such opening formed in such building.

Yet another embodiment of the invention provides a window system for installing a plurality of windows which enables easy cleaning and substantially eliminates the need for frames surrounding the pane. The window system comprises a center pane of glass, having a first predetermined width, height and thickness for at least partially covering a first portion of an opening formed in a wall of a structure. There are a pair of panes of glass, each of the pair of panes are disposed on an opposite side of the center pane. A first pane of the pair of panes having a second predetermined width, height and thickness for at least partially covering a second portion of such opening formed in such wall of such structure and a second pane of the pair of panes having a third predetermined width, height and thickness for at least partially covering a third portion of such opening formed in such wall of such structure. There are at least two hinges disposed on each of the pair of panes along the predetermined height on each of the pair of panes on a predetermined side on an outer periphery thereof. A first one of the hinges being secured to the predetermined side closely adjacent one end thereof and a second hinge of the at least two hinges being secured to the predetermined side closely adjacent a radially opposed end thereof. At least one magnet is secured to at least one of each of the pair of panes on a side opposite at least two hinges and such opening formed in such structure and at least one metallic member disposed on an opposite one of each of the pair of panes and such opening formed in such structure for maintaining each of the panes in a closed position.

OBJECTS OF THE INVENTION

It is one of the objects of the present invention to provide a window system in which the windows are mounted with hinges.

Another object of the present invention is to provide a window system in which the windows use magnets for closing such windows.

Yet another object of the present invention is to provide a window system in which the windows can be secured by a lock.

Still another object of the present invention is to provide a window system in which the panes do not require a frame surrounding the pane.

Another object of the present invention is to provide a window system that uses transition glass so as to block out ultraviolet rays.

Additionally it is an object of the present invention to provide a window system in which both the inside and outside parts of the windows can be cleaned easily from the inside.

In addition to the various objects and advantages of the invention which have been described in some specific detail above it should be noted that various other objects and advantages of the present invention will become more readily apparent to those persons who are skilled in the relevant art from the following more detailed description, particularly, when such description is taken in conjunction with the attached drawing Figures and with the appended claims.

Figure 2:
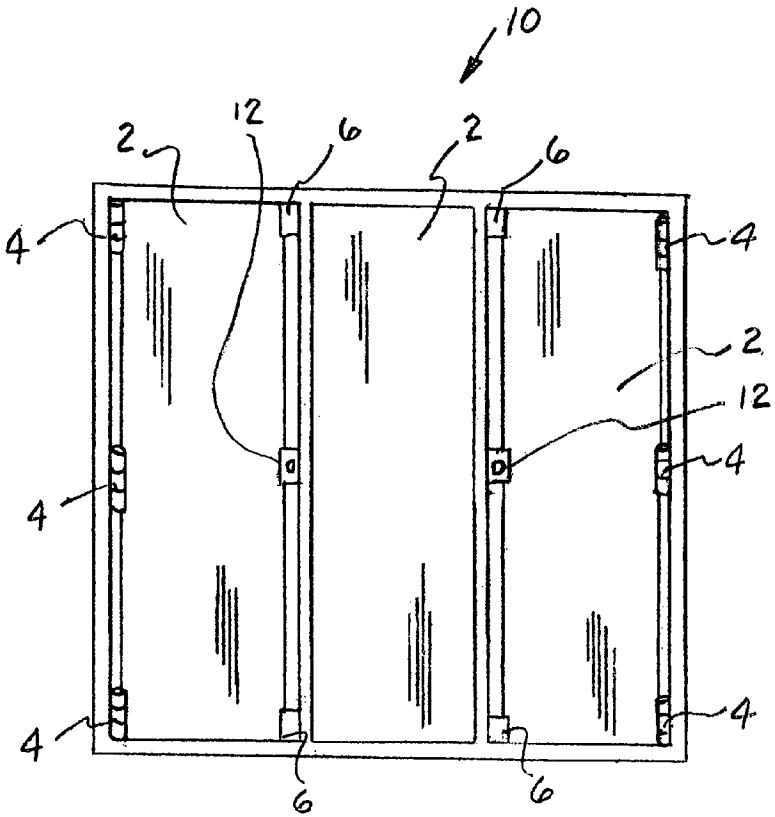
FIG. 2 is a partial perspective front view of the window system wherein there are multiple windows.

BRIEF DESCRIPTION OF THE PRESENTLY PREFERRED AND VARIOUS ALTERNATIVE EMBODIMENTS OF THE INVENTION

Prior to proceeding to the more detailed description of the invention, it should be noted that identical components having identical functions have been designated with identical reference numerals throughout the several views illustrated in the drawings for the sake of clarity.

Figure 1:
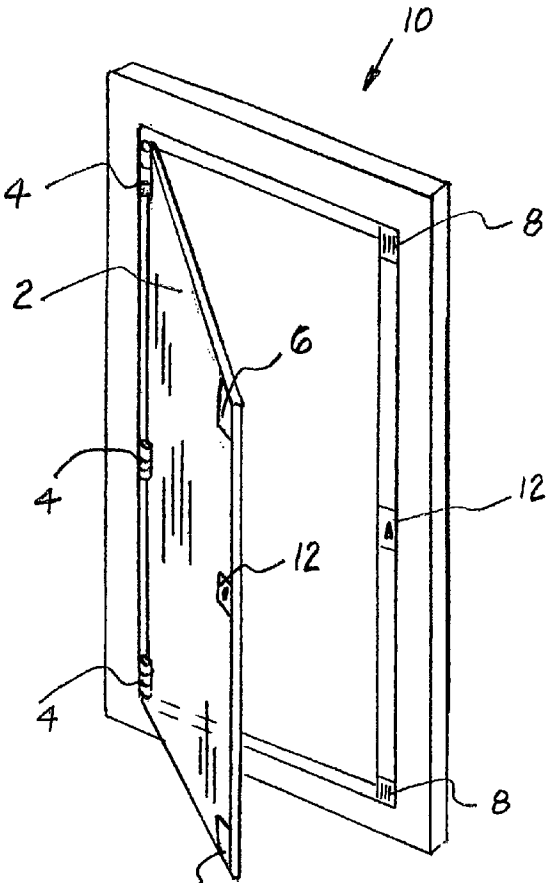
FIG. 1 is a partial perspective front view of the window system according to an embodiment of the invention.
Figure 4:
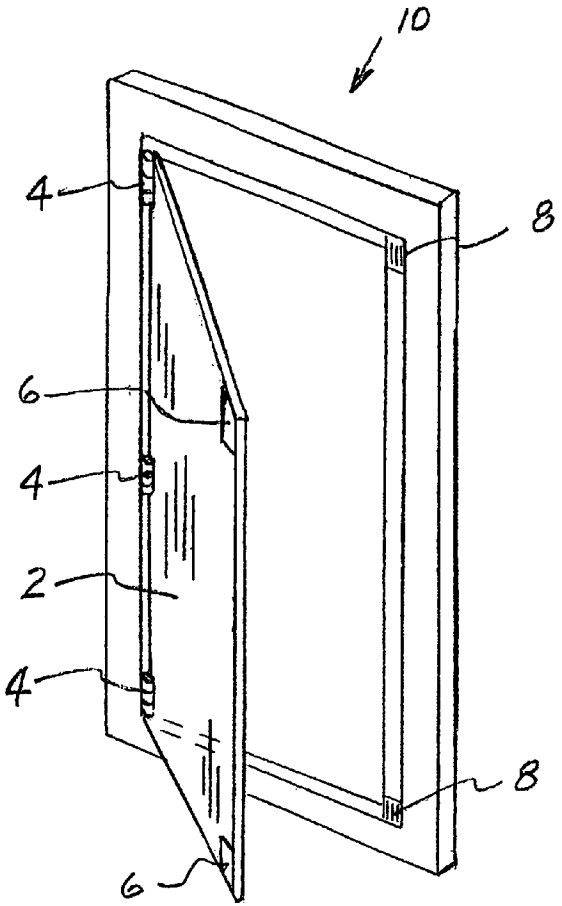
FIG. 4 is a partial perspective front view of the window system according to an alternate embodiment of the invention.
Figure 3:
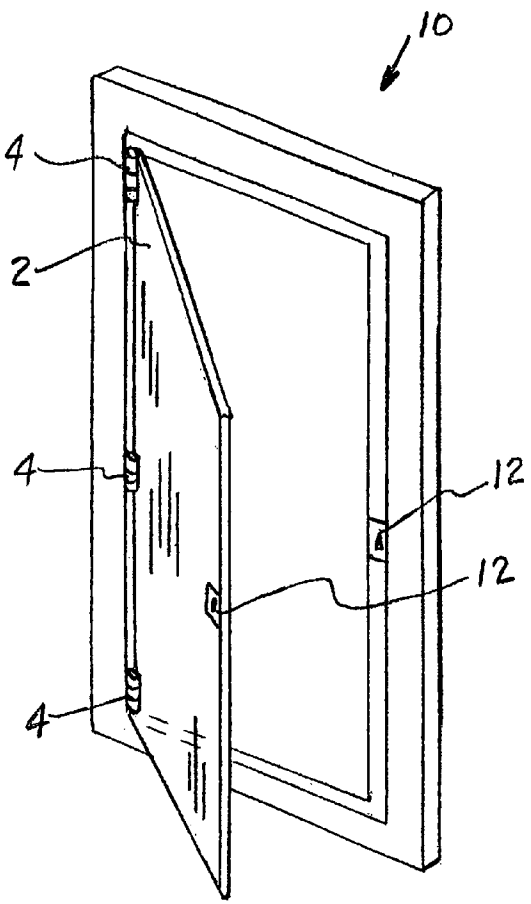
FIG. 3 is a partial perspective front view of the window system according to yet another embodiment of the invention.
Figure 5:
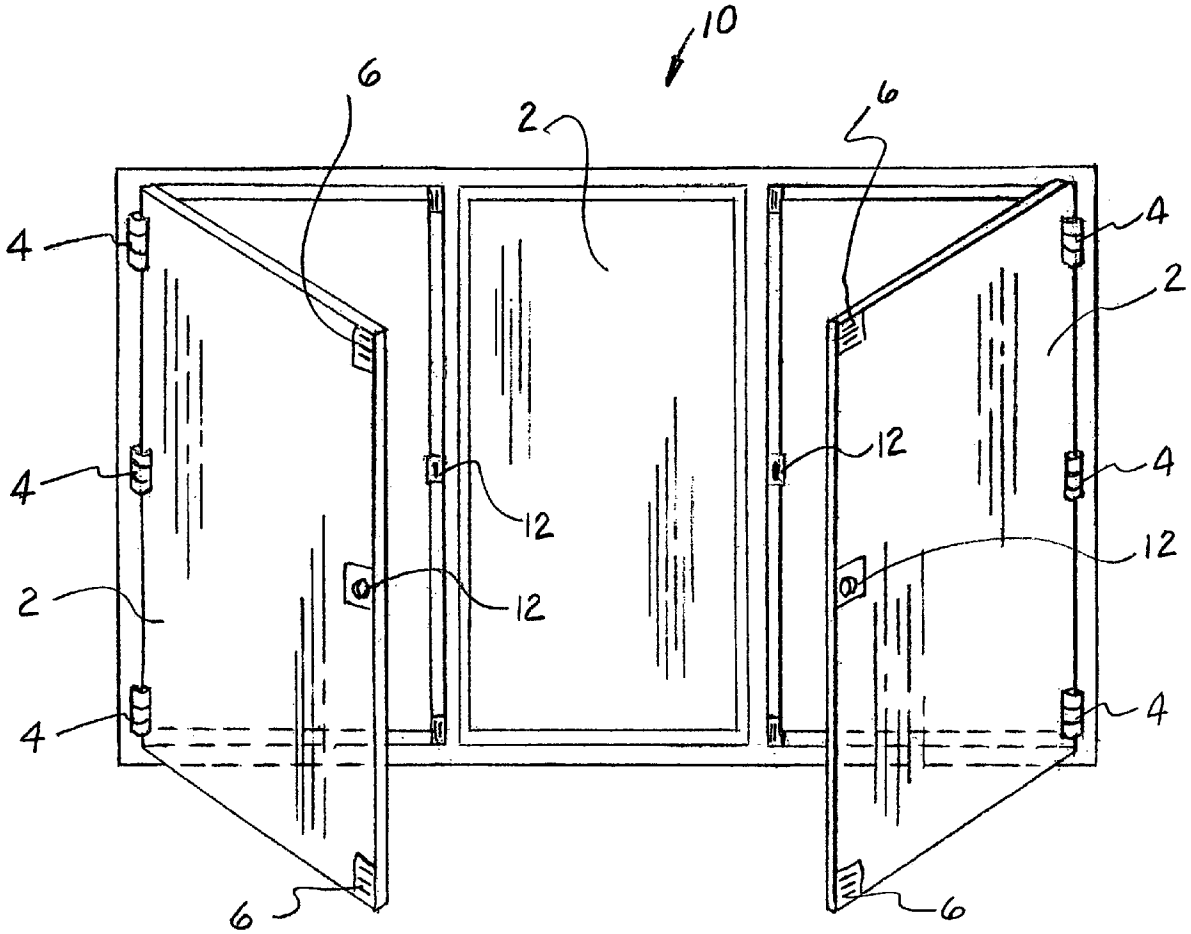
FIG. 5 is a partial perspective front view of the window system shown in FIG. 4 wherein the side panes are partially open.

Thus, the present invention, illustrated in FIGS. 1 and 3 provides a window system, generally designated 10, for installing windows (panes 2) which enables easy cleaning and substantially eliminates the need for frames surrounding the panes 2. The window system 10 comprises at least one pane 2 of glass having each of a predetermined width, height and thickness for at least partially covering an opening formed in a wall of a structure (not shown). There are at least two hinges 4 disposed along the predetermined height of the at least one pane 2 of glass on a predetermined side thereof.

A first hinge 4 is secured to the predetermined side adjacent one end thereof and a second hinge 4 is secured to the predetermined side adjacent a radially opposed end thereof. In a presently preferred embodiment of the invention there are three hinges 4 disposed on the pane with the third hinge 4 being disposed at substantially a midpoint between the other two hinges 4.

There is at least one magnet 6 secured to either the at least one pane 2 of glass or to the framework surrounding such opening formed in such structure and at least one metallic member 8 disposed on an opposite one of the pane 2 of glass or such framework around such opening formed in such structure for maintaining the pane 2 of glass in a closed position. Also in a presently preferred embodiment of the invention there are two magnets 6 disposed on the pane 2, generally on the top and bottom of the pane 2 while the magnetic strips 8 are disposed on the opening opposite the magnets 6. Such window system 10 may also have a locking member 12 for securing the pane 2 against the opening. When a locking member 12 is employed a portion of such locking member 12 is disposed on the pane 2, while another portion of the locking member 12 is mounted on the opening so as to secure the pane 2 in a closed position. As is evident in the drawing Figures there is no need for a frame to surround the pane 2 as the pane 2 is held by the hinges 4 and the magnets 6 when the pane 2 is in a closed position.

An alternate embodiment of the invention, illustrated in FIG. 2, provides a window system 10 for installing windows which enables easy cleaning and substantially eliminates the need for frames surrounding the panes 2. The window system 10 comprises at least one pane 2 of glass having each of a predetermined width, height and thickness for at least partially covering an opening formed in a wall of a structure (building). There are at least two hinges 4 disposed along the predetermined height of the pane 2 of glass on a predetermined side thereof. A first hinge 4 being secured to the predetermined side adjacent one end thereof and the second hinge 4 being secured to the predetermined side adjacent a radially opposed end thereof. There is locking member 12 having one portion secured to one of the at least one pane 2 of glass and another portion secured to such opening formed in such building.

Yet another embodiment of the invention provides a window system 10 for installing a plurality of windows which enables easy cleaning and substantially eliminates the need for frames surrounding the pane 2. The window system 10 comprises a center pane 2 of glass, having a first predetermined width, height and thickness for at least partially covering a first portion of an opening formed in a wall of a structure.

There are a pair of panes 2 of glass, each of the pair of panes 2 are disposed on an opposite side of the center pane 2. A first pane 2 of the pair of panes 2 having a second predetermined width, height and thickness for at least partially covering a second portion of such opening formed in such wall of such structure and a second pane 2 of the pair of panes 2 having a third predetermined width, height and thickness for at least partially covering a third portion of such opening formed in such wall of such structure. In a presently preferred embodiment of the invention such first, second and third predetermined heights and predetermined thicknesses are virtually identical.

There are at least two hinges 4 that are disposed on each of the pair of panes 2 along the predetermined height on each of the pair of panes 2 on a predetermined side on an outer periphery thereof. A first one of the hinges 4 being secured to the predetermined side closely adjacent one end of the pane 2 thereof and a second hinge 4 of the at least two hinges 4 being secured to the predetermined side of the pane 2 closely adjacent a radially opposed end thereof. It is preferred that there are three hinges 4 disposed on each of the pair of panes 2 with the third hinge 4 being disposed at substantially a midpoint between the other two hinges 4 on each of he pair of panes 2.

At least one magnet 6 is secured to at least one of each of the pair of panes 2 on a side opposite at least two hinges 4 and a frame around such opening formed in such structure and at least one metallic member 8 disposed on an opposite one of each of the pair of panes 2 and such opening formed in such structure for maintaining each of the panes 2 in a closed position. It is also preferred that there are two magnets 6 disposed on each of the pair of panes 2 with a corresponding metallic strip 8 disposed on the framework surrounding such opening opposite each magnet 6.

Such window system 10 may also include a locking member 12, a portion of such locking member 12 is disposed on each of the pair of panes 2, while another portion of the locking member 12 is disposed on the openings to the secure the panes 2 in a closed position.

Similar to the first embodiment, it is preferred that there are three hinges 4 disposed on each of the outer panes 2. The center pane 2 does not move but the outer panes 2 open in opposite directions since the hinges 4 are on the outer edge of the panes 2. Thus, the center pane 2 is cleaned by opening the outer panes 2 and reaching in to clean the outside of the center pane 2.

It is presently preferred that such predetermined heights and thicknesses for the three panes in this embodiment be substantially identical. This embodiment also includes a locking member 12 for the two outer panes 2 to secure the panes 2. It is also preferred that there are two magnets 6 on each of the outer panes 2 with corresponding metallic strips 12 on the opening. The panes in the closed position are held in place by the magnets 6 and further secured for security by the locking member 12.

It is also presently preferred that such panes 2 in all of the embodiments discussed supra be made of transition glass. That way the window pane 2 with change when the sun comes through it so as to block out ultraviolet rays and also block out some sunlight particularly where the sun is bright without blocking out all of the light. The window 2 would be clear but when the sun hits the pane 2 it would have a tint. There could be different tints to match the taste, style or home decor.

It is within the scope of the invention that such locking member 12 could be a twist lock or a slide lock.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. A window system for installing a plurality of windows which enables easy cleaning and substantially eliminates the need for frames surrounding the pane, said window system comprising:

(a) a center pane of glass, having a first predetermined width, height and thickness for at least partially covering a first portion of an opening formed in a wall of a structure;

(b) a pair of panes of glass, each of said pair of panes disposed on an opposite side of said center pane, a first pane of said pair of panes having a second predetermined width, height and thickness for at least partially covering a second portion of such opening formed in such wall of such structure and a second of said pair of panes having a third predetermined width, height and thickness for at least partially covering a third portion of such opening formed in such wall of such structure;

(c) at least two hinges disposed on each of said pair of panes along said second predetermined height and said third predetermined height on each of said pair of panes on a predetermined side on an outer periphery thereof, a first one of said at least two hinges being secured to said predetermined side closely adjacent one end thereof and a second one of said at least two hinges being secured to said predetermined side closely adjacent a radially opposed end thereof;

(d) at least one magnet secured to one of at least one of each of said pair of panes on a side opposite said at least two hinges and such opening formed in such structure; and (e) at least one metallic member disposed on an opposite one of said each of said pair of panes and such opening formed in such structure for maintaining said each of said pair of panes in a closed position.

2. The window system, according to claim 1, wherein said system further includes a lock for securing said each of said pair of panes.

3. The window system, according to claim 1, wherein said first, said second and said third predetermined heights are similar.

4. The window system, according to claim 1, wherein said at least one magnet is secured to said each of said pair of panes.

5. The window system, according to claim 4, wherein two magnets are secured to said each of said pair of panes.

6. The window system, according to claim 1, wherein there are three hinges disposed along said predetermined height of said each of said pair of panes.

7. The window system, according to claim 1, wherein said first, said second and said third predetermined thickness are similar.

8. The window system, according to claim 1, wherein said window system further includes transition glass.

* * * * *